US012722862B2

(12) United States Patent
Tanaka et al.

(10) Patent No.: US 12,722,862 B2
(45) Date of Patent: Sep. 1, 2026

(54) SPOUT POUCH

(71) Applicant: Toyo Seikan Co., Ltd., Tokyo (JP)

(72) Inventors: Hiroki Tanaka, Yokohama (JP); Soya Yoshida, Yokohama (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 106 days.

(21) Appl. No.: 18/813,867

(22) Filed: Aug. 23, 2024

(65) Prior Publication Data

US 2024/0409293 A1 Dec. 12, 2024

Related U.S. Application Data

(63) Continuation of application No. PCT/JP2023/002582, filed on Jan. 27, 2023.

(30) Foreign Application Priority Data

Mar. 7, 2022 (JP) ..... 2022-034137

(51) Int. Cl.
*B65D 75/58* (2006.01)
*B65D 75/00* (2006.01)
*B65D 75/56* (2006.01)

(52) U.S. Cl.
CPC ..... *B65D 75/5877* (2013.01); *B65D 75/008* (2013.01); *B65D 75/563* (2013.01)

(58) Field of Classification Search
CPC ..... B65D 75/5877; B65D 75/008; B65D 75/563; B65D 75/566; B65D 75/5883; B65D 75/5861
See application file for complete search history.

(56) References Cited

U.S. PATENT DOCUMENTS 9,463,969 B2 * 10/2016 Hartley ..... B67D 3/0067
2005/0220369 A1 * 10/2005 Sullivan ..... B65D 75/563 383/14

(Continued)

FOREIGN PATENT DOCUMENTS

CN 204624182 U 9/2015
JP 10095461 A 4/1998

(Continued)

OTHER PUBLICATIONS

International Search Report dated Mar. 14, 2023, issued in counterpart International Application No. PCT/JP2023/002582 (2 pages).

(Continued)

*Primary Examiner* — Bob Zadeh
(74) *Attorney, Agent, or Firm* — WHDA, LLP

(57) ABSTRACT

To provide a spout pouch that improves easiness of spouting a content liquid through a spout and suppresses breakage of a pouch main body with the vicinity of a flange outer peripheral edge as a starting point. There is provided a spout pouch in which at least a part of a flange of a spout is disposed facing a region between an upper side inclined edge portion of a front side outer edge and an upper side inclined edge portion of a rear side outer edge, and at least a part of a grip-use film penetrating portion is formed in a second upper side sealing region of a second side seal or a second outer side non-sealing region.

16 Claims, 9 Drawing Sheets

(56) References Cited

U.S. PATENT DOCUMENTS

| | | | | |
|---|---|---|---|---|
| 2015/0125097 | A1* | 5/2015 | Kenmotsu | B65D 33/16 383/42 |
| 2017/0144800 | A1* | 5/2017 | Lucchese | B65D 75/566 |
| 2021/0362928 | A1 | 11/2021 | Tanaka et al. | |
| 2024/0409293 | A1* | 12/2024 | Tanaka | B65D 75/5877 |

FOREIGN PATENT DOCUMENTS

| | | | | |
|---|---|---|---|---|
| JP | H1095461 | A | * | 4/1998 |
| JP | 2017210257 | A | * | 11/2017 |
| JP | 2018165171 | A | * | 10/2018 |
| JP | 2020-132177 | A | | 8/2020 |
| KR | 20030059059 | A | * | 7/2003 |
| KR | 20030062282 | A | * | 7/2003 |

OTHER PUBLICATIONS

Office Action dated Mar. 31, 2026, issued in counterpart CN Application No. 202380016895.5, with English translation. (16 pages).

* cited by examiner

SPOUT POUCH

TECHNICAL FIELD

The disclosure relates to a spout pouch in which a spout is attached to a first gusset film of a pouch side portion.

BACKGROUND

Conventionally, the present applicant has proposed, in JP 2020-132177 A, a spout pouch in which a spout is laterally attached to a first gusset film of a pouch main body formed by thermally sealing a plurality of resin films as a container for accommodating a content liquid such as a beverage or a liquid detergent.

Further, as a method of attaching a spout of such a spout pouch, there has also been generally known a method of arranging a flange of the spout to the first gusset film so as to face the first gusset film, and fixing the flange to the first gusset film by a method such as thermal sealing.

SUMMARY

However, as for the spout pouch disclosed in JP 2020-132177 A, in a usage mode in which the pouch is lifted to spout the content liquid or the like, the spout may unexpectedly move due to a weight of the content liquid contained in the spout or the like at the time of spouting the content liquid, resulting in the problem that an orientation of a spouting tubular portion of the spout is difficult to set, and making it difficult to spout the content liquid.

Moreover, regarding the known spout pouch, a problem arises that, when the spout pouch is dropped or the like, the first gusset film may be damaged in the vicinity of a flange outer peripheral edge due to a weight of the content, breaking the pouch main body with the vicinity of the flange outer peripheral edge as a starting point.

The breakage of the pouch main body is presumably caused by the spout rotating (tilting) with respect to the first gusset film when the spout pouch is dropped, a moment load being applied to the vicinity of the flange outer peripheral edge, and the vicinity of the flange outer peripheral edge, with the moment load applied, being struck on a floor or the like.

The disclosure has been made to solve these problems, and an object of the disclosure is to provide a spout pouch that, with a simple configuration, improves easiness of spouting a content liquid through a spout, and suppresses breakage of a pouch main body with the vicinity of a flange outer peripheral edge as a starting point.

In order to solve the above-described problem, according to an aspect of the disclosure, there has been provided a spout pouch including a front side film, a rear side film, a first gusset film thermally sealed to the front side film and the rear side film by using a first side seal, a second gusset film disposed facing the first gusset film in a front-back direction with a content liquid accommodating portion interposed between the first gusset film and the second gusset film, the second gusset film being thermally sealed to the front side film and the rear side film by using a second side seal, a spout attached to the first gusset film, and a grip-use film penetrating portion configured to be gripped by a user, wherein the first gusset film includes a first front side sealing region thermally sealed to the front side film at the first side seal, a first rear side sealing region thermally sealed to the rear side film at the first side seal, and a first non-sealing region serving as a region inside the first front side sealing region and the first rear side sealing region, the first non-sealing region includes a first front side outer edge serving as a boundary with the first front side sealing region, and a first rear side outer edge serving as a boundary with the first rear side sealing region, each of the first front side outer edge and the first rear side outer edge includes a first base edge portion, the first base edge portion of the first front side outer edge and the first base edge portion of the first rear side outer edge being disposed spaced apart from each other in a front-rear direction, and a first upper side inclined edge portion extending from an upper end of the first base edge portion to a first upper end coupling portion coupling an upper end of the first front side outer edge and an upper end of the first rear side outer edge, the second gusset film includes a second front side sealing region thermally sealed to the front side film at the second side seal, a second rear side sealing region thermally sealed to the rear side film at the second side seal, and a second non-sealing region serving as a region inside the second front side sealing region and the second rear side sealing region, the second non-sealing region includes a second front side outer edge serving as a boundary with the second front side sealing region, and a second rear side outer edge serving as a boundary with the second rear side sealing region, each of the second front side outer edge and the second rear side outer edge includes a second base edge portion, the second base edge portion of the second front side outer edge and the second base edge portion of the second rear side outer edge being disposed spaced apart from each other in the front-rear direction, and a second upper side inclined edge portion extending from an upper end of the second base edge portion to a second upper end coupling portion coupling an upper end of the second front side outer edge and an upper end of the second rear side outer edge, at least a portion of a flange of the spout is disposed facing a region between the first upper side inclined edge portion of the first front side outer edge and the first upper side inclined edge portion of the first rear side outer edge, and the second side seal includes a second side sealing region positioned on a side of the second base edge portion and a second upper side sealing region positioned more upward than the second side sealing region.

Further, according to another aspect of the disclosure, there has been provided a spout pouch including a front side film, a rear side film, a first gusset film thermally sealed to the front side film and the rear side film by using a first side seal, a second gusset film disposed facing the first gusset film in a front-back direction with a content liquid accommodating portion interposed between the first gusset film and the second gusset film, the second gusset film being thermally sealed to the front side film and the rear side film by using a second side seal, and a spout attached to the first gusset film, wherein the first gusset film includes a first front side sealing region thermally sealed to the front side film at the first side seal, a first rear side sealing region thermally sealed to the rear side film at the first side seal, and a first non-sealing region serving as a region inside the first front side sealing region and the first rear side sealing region, the first non-sealing region includes a first front side outer edge serving as a boundary with the first front side sealing region, and a first rear side outer edge serving as a boundary with the first rear side sealing region, each of the first front side outer edge and the first rear side outer edge includes a first base edge portion, the first base edge portion of the first front side outer edge and the first base edge portion of the first rear side outer edge being disposed spaced apart from each other in a front-rear direction, and a first upper side inclined edge portion extending from an upper end of the first base edge portion to a first upper end coupling portion coupling an upper end of the first front side outer edge and an upper end of the first rear side outer edge, the second gusset film includes a second front side sealing region thermally sealed to the front side film at the second side seal, a second rear side sealing region thermally sealed to the rear side film at the second side seal, and a second non-sealing region serving as a region inside the second front side sealing region and the second rear side sealing region, the second non-sealing region includes a second front side outer edge serving as a boundary with the second front side sealing region, and a second rear side outer edge serving as a boundary with the second rear side sealing region, each of the second front side outer edge and the second rear side outer edge includes a second base edge portion, the second base edge portion of the second front side outer edge and the second base edge portion of the second rear side outer edge being disposed spaced apart from each other in the front-rear direction, and a second upper side inclined edge portion extending from an upper end of the second base edge portion to a second upper end coupling portion coupling an upper end of the second front side outer edge and an upper end of the second rear side outer edge, at least a portion of a flange of the spout is disposed facing a region between the first upper side inclined edge portion of the first front side outer edge and the first upper side inclined edge portion of the first rear side outer edge, a top seal fixing the front side film and the rear side film between the first side seal and the second side seal in the front-back direction is provided, the top seal includes a top seal inner edge facing a side at which the content liquid accommodating portion is provided, and the top seal inner edge includes a portion downwardly inclined from a side at which the first upper end coupling portion is provided toward a side at which the second upper end coupling portion is provided, and is formed to couple the first upper end coupling portion and the second upper end coupling portion.

According to the invention of claim 1, at least a portion of the flange of the spout is disposed facing a region between the first upper side inclined edge portions of the first gusset film. This makes it possible to narrow an interval between an inner edge of the first side seal and a flange outer peripheral edge to restrain movement of the spout without affecting a self-standing property of a pouch main body and the like, and thus to favorably define an orientation of a spouting tubular portion of the spout and to improve easiness of spouting the content liquid through the spout. That is, by arranging the flange of the spout in the region between the first upper side inclined edge portions, which has a narrow lateral width in the front-rear direction as compared with the region between the first base edge portions, it is possible to not only narrow an interval between the inner edge of the sealing region (first side seal) of the first gusset film and the flange outer peripheral edge, but also, because the region between the first upper side inclined edge portions is a portion of the first gusset film that is positioned on the upper side in a state in which the spout pouch is placed on a placement surface, and is a portion in which a design change of the edge portion shape does not affect the self-standing property of the pouch main body and the like, to freely change the design of the edge portion shape and favorably restrain the movement of the spout.

Further, according to the invention of claim 1, the region between the first upper side inclined edge portions of the first gusset film is a portion that inclines inward of the pouch main body toward the upper side in a state in which the spout pouch is placed on the placement surface and thus, even when the spout pouch is dropped with the position of the flange of the spout recessed inward of the pouch main body, it is easy to make it difficult for the first gusset film in the vicinity of the flange outer peripheral edge to hit the floor or the like, making it possible to suppress breakage of the pouch main body with the vicinity of the flange outer peripheral edge as a starting point and to inwardly retract a tip end position of the spouting tubular portion of the spout into the pouch main body as compared with a case in which the spout is attached in a region between the first base edge portions of the first gusset film.

According to the invention of claim 2, forming the grip-use film penetrating portion by utilizing the second upper side sealing region serving as the upper side portion of the second side seal improves the degree of freedom in design related to a width of the top seal in an up-down direction or the like, and accordingly a position of the first upper end coupling portion of the first side seal can be shifted to the upper side, and an attaching position of the spout can be shifted to the upper side. Therefore, the content liquid can be accommodated up to a higher position in the content liquid accommodating portion while unexpected leakage of the content liquid from the spout is being avoided when the spout pouch is lifted up by utilizing the grip-use film penetrating portion.

Further, according to the invention of claim 2, since the grip-use film penetrating portion is formed by utilizing the second upper side sealing region serving as the upper side portion of the second side seal, there are two second upper side sealing regions. Thus, a range of design, such as whether the grip-use film penetrating portion is formed at both of the second upper side sealing regions positioned at both sides in the front-rear direction or at only one of the second upper side sealing regions, and how a separated state of the second upper side sealing regions positioned at both sides in the front-rear direction is designed, can be widened and the degree of freedom in design of the grip-use film penetrating portion can be improved.

According to the invention of claim 3, since a part or the whole of the grip-use film penetrating portion is formed in a second outer side non-sealing region, the degree of freedom in design of the width of the top seal in the up-down direction or the like can be improved. Therefore, the position of the first upper end coupling portion of the first side seal is shifted toward the upper side and thus an attaching position of the spout can be easily shifted to the upper side.

According to the invention of claim 4, since the second upper end coupling portion is formed at a position lower than the first upper end coupling portion in the up-down direction, the second upper side sealing region serving as the upper side portion of the second side seal can be enlarged. Therefore, the degree of freedom in designing a size, a shape, and the like of the grip-use film penetrating portion can be improved.

According to the invention of claim 5, the top seal inner edge includes a portion downwardly inclined from the first upper end coupling portion side toward the second upper end coupling portion side, and is formed to couple the first upper end coupling portion and the second upper end coupling portion. Thus, when the spout pouch is dropped with the top seal side facing downward, and the top seal is buckled due to the weight of the content liquid in the content liquid accommodating portion at the time of collision with the floor surface or the like, a posture of the pouch main body can be guided such that the first upper end coupling portion attached with the spout is positioned more upward than the second upper end coupling portion, resulting in suppressing collision of the spout with the floor surface or the like and suppressing breakage of the spout and leakage of the content liquid caused by the breakage.

Further, according to the invention of claim 5, the top seal inner edge includes a portion downwardly inclined from the first upper end coupling portion side toward the second upper end coupling portion side and is formed to couple the first upper end coupling portion and the second upper end coupling portion, which makes it possible to avoid formation of a corner portion with a protruding shape that tends to become an occurrence point of the bag breakage when the spout pouch is dropped or the like. That is, when the corner portion with the protruding shape is formed on an inner side of the pouch at an inner edge portion of a sealing portion for bag production constituted by the top seal and the side seal, the corner portion tends to become the occurrence point of the bag breakage where film breakage is likely to occur. According to the invention of claim 5, the top seal inner edge includes a portion downwardly inclined from the first upper end coupling portion side toward the second upper end coupling portion side and is formed to couple the first upper end coupling portion and the second upper end coupling portion, which makes it possible to avoid the formation of the corner portion with the protruding shape that tends to become the above-described occurrence point of the bag breakage.

According to the invention of claim 6, a folding-use coupling portion of the grip-use piece portion is formed in the second upper side sealing region having a higher degree of freedom in design than that of the top seal, which makes it possible to improve the degree of freedom in design of the folding-use coupling portion that comes into contact with a finger or a hand of a user when the spout pouch is lifted up by using the grip-use film penetrating portion.

According to the invention of claims 7 and 8, a fixing control portion fixing the second upper side sealing regions at both sides in the front-rear direction to each other is provided, which makes it possible to control a positional relationship, a separated state, and the like of the grip-use film penetrating portions at the both sides in the front-rear direction. Thus, the easiness of gripping the spout pouch by utilizing the grip-use film penetrating portion can be improved.

According to the invention of claim 9, in addition to the above-described various effects based on the fact that at least a portion of the flange of the spout is disposed facing the region between the first upper side inclined edge portions, the following effects can be obtained. That is, according to the invention of claim 7, since the top seal inner edge includes the portion downwardly inclined from the first upper end coupling portion side toward the second upper end coupling portion side and is formed to couple the first upper end coupling portion and the second upper end coupling portion, when the spout pouch is dropped with the top seal side facing downward, and the top seal is buckled due to the weight of the content liquid in the content liquid accommodating portion at the time of collision with a floor surface or the like, a posture of the pouch main body can be guided such that the first upper end coupling portion attached with the spout is positioned more upward than the second upper end coupling portion. Accordingly, an impact on the spout from the floor surface or the like can be suppressed, and breakage of the spout and leakage of the content liquid caused by the breakage can be suppressed.

DESCRIPTION OF EMBODIMENTS

A spout pouch 10 according to an embodiment of the disclosure will be described below with reference to the accompanying drawings.

Figure 1:
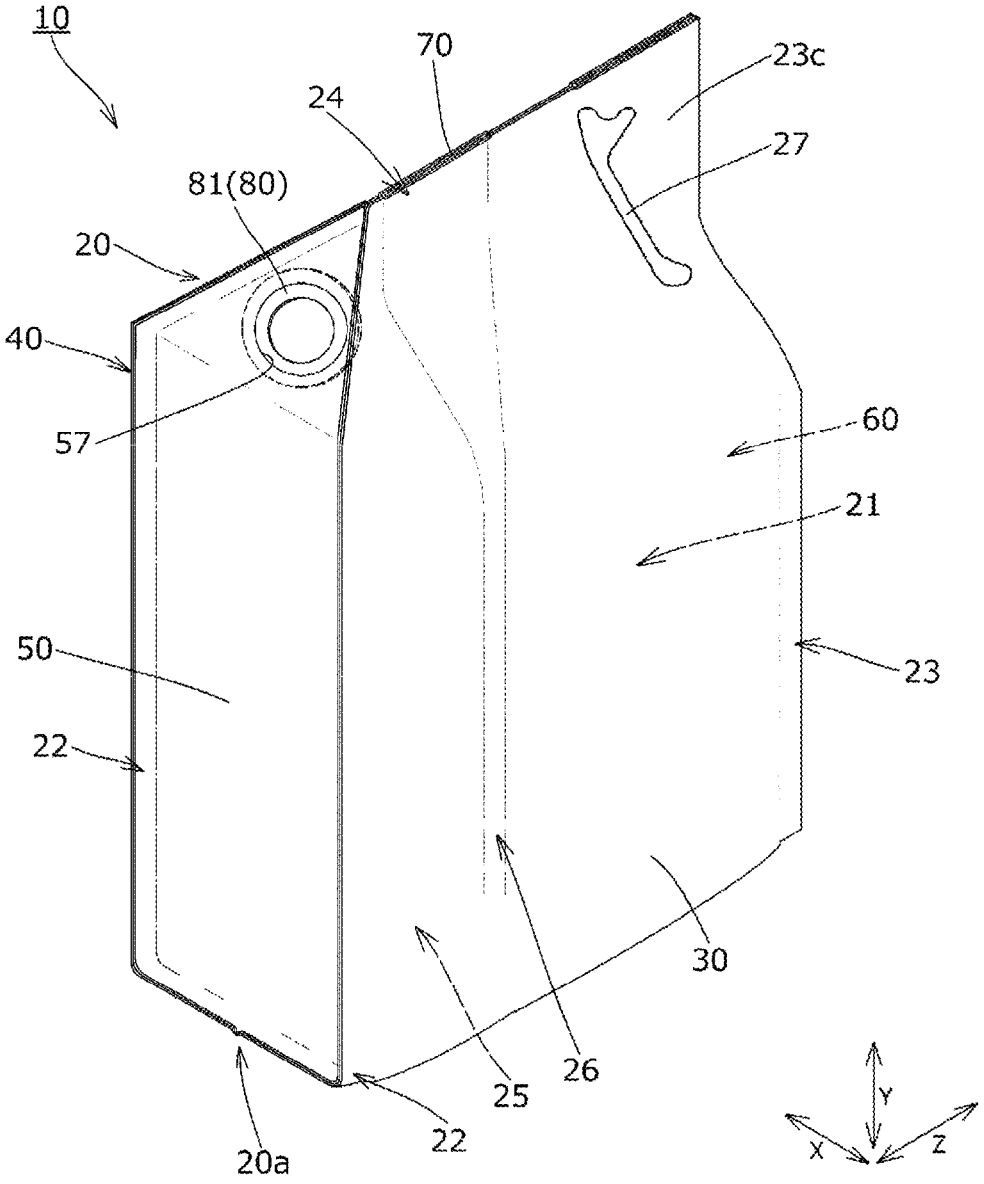
FIG. 1 is an explanatory view illustrating a state in which a spout pouch according to an embodiment of the disclosure is placed on a placement surface.

The spout pouch 10 accommodates a content liquid, such as a beverage or a liquid detergent, and is configured to spout the content liquid from a spout 80 attached to a side portion of a pouch main body 20 as illustrated in FIG. 1.

As illustrated in FIG. 1, the spout pouch 10 includes the pouch main body 20 formed into a bag shape by thermally sealing films 30, 40, 50, and 60 having flexibility to form a sealing portion for bag production, an inner side film 70 disposed inside the pouch main body 20, and the spout 80 attached to the pouch main body 20.

Figure 2:
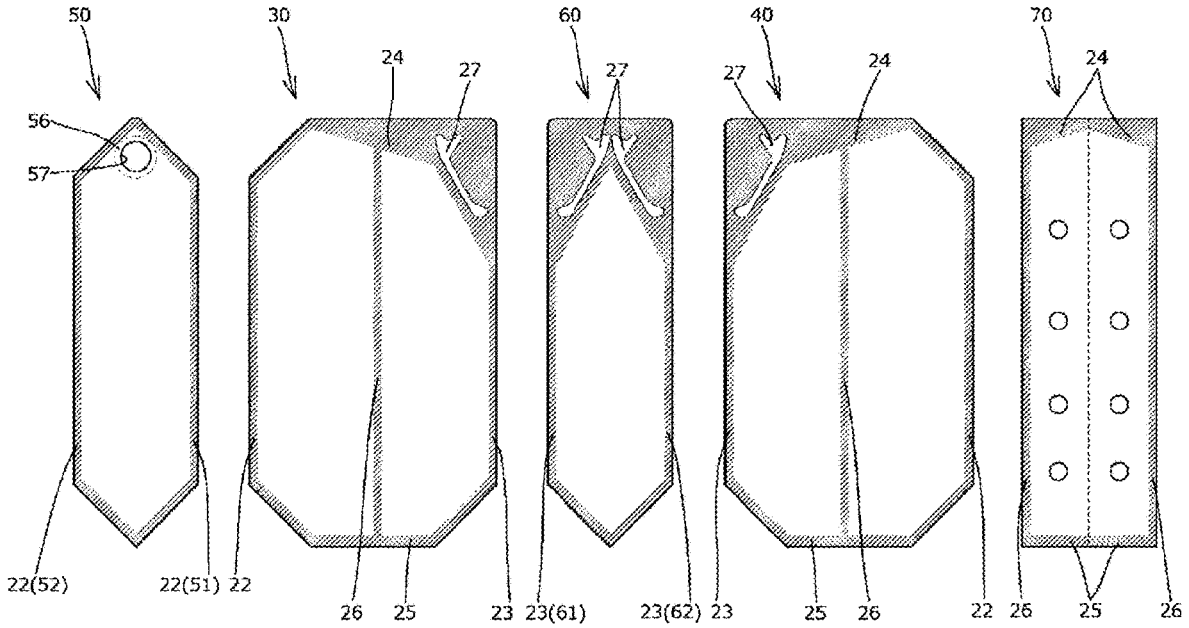
FIG. 2 is an explanatory view illustrating each film constituting the spout pouch.

The pouch main body 20 is configured as a so-called lateral gusset-type pouch formed with gusset portions at both side portions and, as illustrated in FIG. 1 and FIG. 2, includes the front side film 30 and the rear side film 40 disposed facing each other in a front-rear direction X with a content liquid accommodating portion 21 interposed therebetween, the first gusset film 50 disposed between the front side film 30 and the rear side film 40 at one of pouch side portions and thermally sealed to the front side film 30 and the rear side film 40 by using a first side seal 22, and the second gusset film 60 disposed facing the first gusset film 50 in a front-back direction Z with the content liquid accommodating portion 21 interposed therebetween and thermally sealed to the front side film 30 and the rear side film 40 by using a second side seal 23 at the other of the pouch side portions.

Each of the films 30, 40, 50, 60, and 70 is formed as a resin film including a heat sealing layer on at least one surface thereof, and disposed such that the heat sealing layers face each other at positions where the films are thermally sealed to each other.

Note that, in FIG. 2 and the like, heat sealing regions of the films 30, 40, 50, 60, and 70 are indicated by shading.

As illustrated in FIG. 1 and FIG. 2, the pouch main body 20 includes the first side seal 22 formed by thermally sealing both sides of the first gusset film 50 in a lateral direction to the films 30 and 40, the second side seal 23 formed by thermally sealing both sides of the second gusset film 60 in the lateral direction to the films 30 and 40, a top seal 24 formed by fixing the films 30 and 40 between the first side seal 22 and the second side seal 23 in the front-back direction Z at a position corresponding to a top portion of the pouch main body 20 facing a bottom seal 25 with the content liquid accommodating portion 21 interposed therebetween, the bottom seal 25 fixing the films 30 and 40 at a position corresponding to a pouch bottom portion 20*a* of the pouch main body 20, and an intermediate seal 26 thermally sealing the films 30 and 40 and the inner side film 70. These seals 22 to 26 constitute a sealing portion for bag production.

When the inner side film 70 is provided as in the present embodiment, the top seal 24 and the bottom seal 25 include a portion where the films 30 and 40 are fixed by direct and thermal sealing between the films 30 and 40, and a portion where the inner side film 70 is interposed between the films 30 and 40 and the films 30 and 40 are fixed by thermal sealing between the films 30, 40 and 70.

If the spout pouch 10 is formed without providing the inner side film 70, the top seal 24 and the bottom seal 25 are constituted only by a portion where the films 30 and 40 are fixed to each other by direct and thermal sealing between the films 30 and 40.

Figure 3:
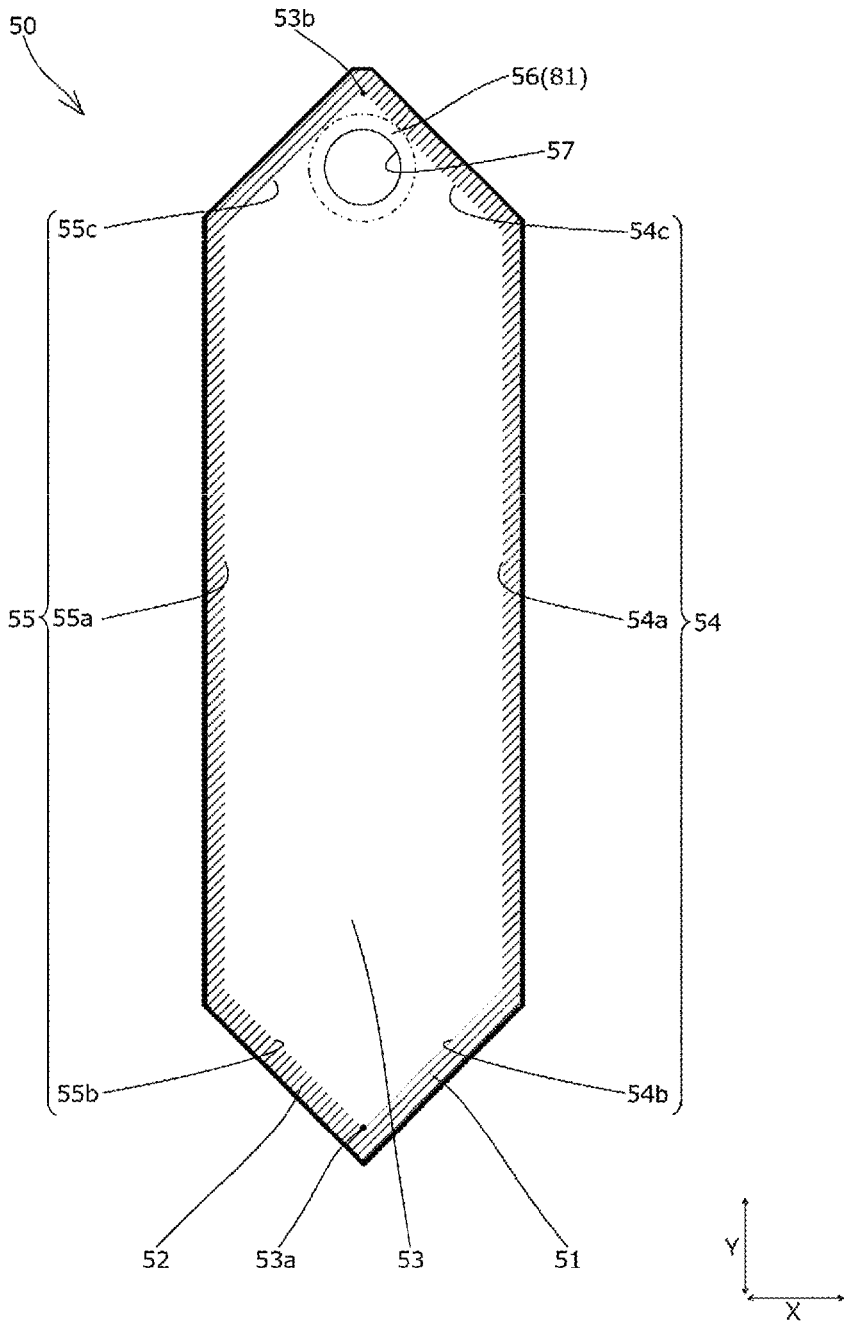
FIG. 3 is an explanatory view illustrating a first gusset film.

As illustrated in FIG. 3, the first gusset film 50 includes a first front side sealing region 51, of the first side seal 22, thermally sealed to the front side film 30, a first rear side sealing region 52, of the first side seal 22, thermally sealed to the rear side film 40, and a non-sealing region 53 that is a region on an inner side of the first front side sealing region 51 and the front rear side sealing region 52.

As illustrated in FIG. 3, the first non-sealing region 53 includes a first front side outer edge 54 serving as a boundary with the first front side sealing region 51, and a first rear side outer edge 55 serving as a boundary with the first rear side sealing region 52.

The first gusset film 50 is formed in line symmetry (left-right symmetry) with respect to a virtual line extending in an up-down direction Y at a central portion of the first gusset film 50 in the front-rear direction X. In other words, the first front side outer edge 54 and the first rear side outer edge 55 are formed in line symmetry (left-right symmetry) with respect to the virtual line.

As illustrated in FIG. 3, the first front side outer edge 54 and the first rear side outer edge 55 respectively include first base edge portions 54*a* and 55*a* disposed spaced apart from each other in the front-rear direction X, first lower side inclined edge portions 54*b* and 55*b* respectively extending from lower ends of the first base edge portions 54*a* and 55*a* to a first lower end coupling portion 53*a* coupling lower ends of the first front side outer edge 54 and the first rear side outer edge 55 to each other, and first upper side inclined edge portions 54*c* and 55*c* respectively extending from upper ends of the first base edge portions 54*a* and 55*a* to an upper end coupling portion 53*b* coupling upper ends of the first front side outer edge 54 and the first rear side outer edge 55 to each other.

As illustrated in FIG. 3, the first base edge portions 54*a* and 55*a* are formed linearly extending in the up-down direction Y.

As illustrated in FIG. 3, the first lower side inclined edge portions 54*b* and 55*b* extend linearly so as to be inclined in the up-down direction Y inwardly in the front-rear direction X (at an inclination angle of 45° in the present embodiment) toward the lower side.

As illustrated in FIG. 3, the first upper side inclined edge portions 54*c* and 55*c* extend linearly so as to be inclined in the up-down direction Y inwardly in the front-rear direction X (at an inclination angle of 45° in the present embodiment) toward the upper side.

Further, as illustrated in FIG. 3, the first gusset film 50 includes a flange facing region 56 disposed facing a flange 81 of the spout 80. In the present embodiment, the flange facing region 56 is formed in an annular shape with an outer peripheral edge having a circular shape.

Further, the first gusset film 50 includes a spout-use through hole 57 having a circular shape. The spout-use through hole 57 is formed so as to penetrate in a film thickness direction, and is used for inserting a spouting tubular portion 82 of the spout 80 therethrough.

Figure 4:
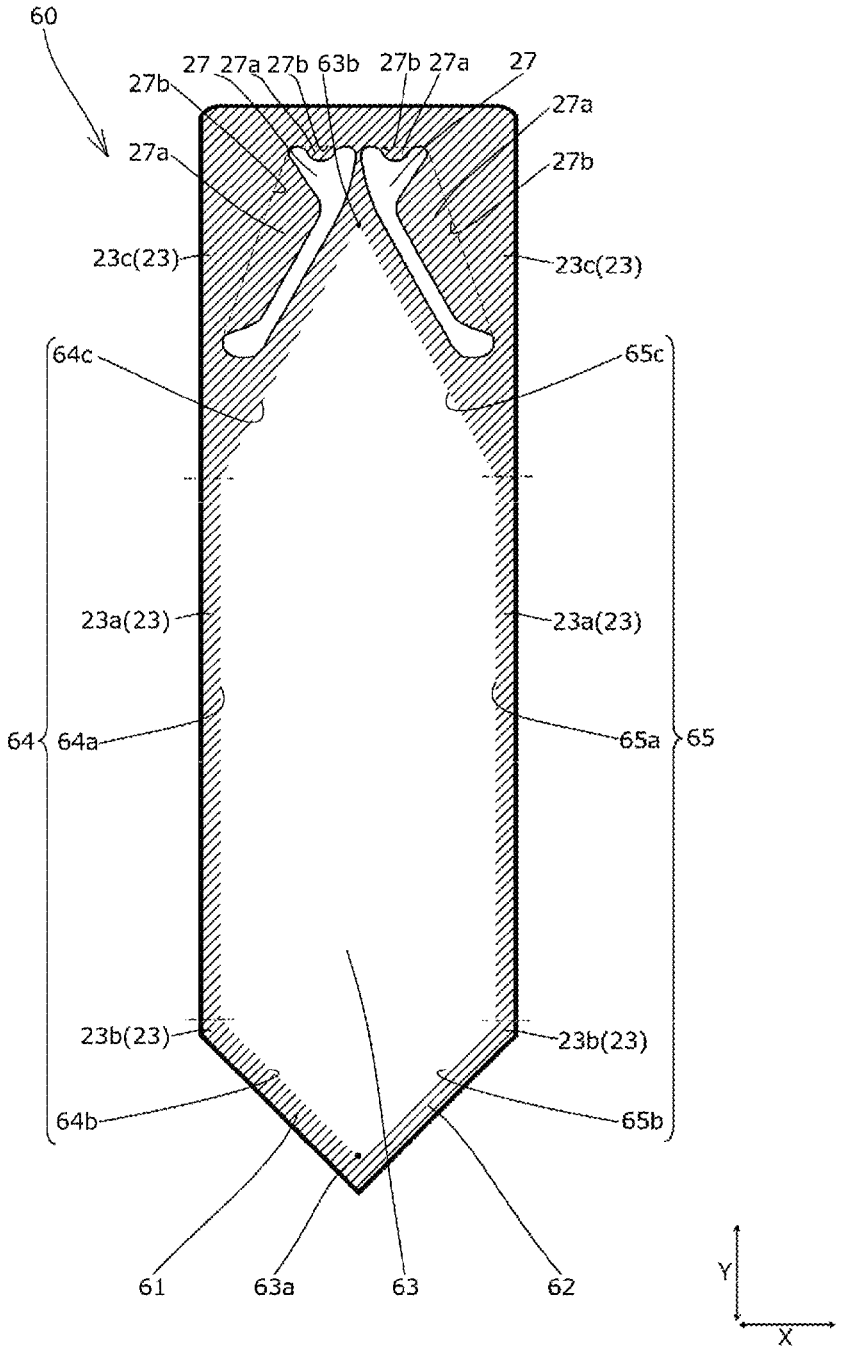
FIG. 4 is an explanatory view illustrating a second gusset film.

As illustrated in FIG. 4, the second gusset film 60 includes a second front side sealing region 61, of the second side seal 23, thermally sealed to the front side film 30, a second rear side sealing region 62, of the second side seal 23, thermally sealed to the rear side film 40, and a second non-sealing region 63 that is a region on an inner side of the second front side sealing region 61 and the second rear side sealing region 62.

As illustrated in FIG. 4, the second non-sealing region 63 includes a second front side outer edge 64 serving as a boundary with the second front side sealing region 61, and a second rear side outer edge 65 serving as a boundary with the second rear side sealing region 62.

The second gusset film 60 is formed in line symmetry (left-right symmetry) with respect to a virtual line extending in the up-down direction Y at a central portion of the second gusset film 60 in the front-rear direction X. In other words, the second front side outer edge 64 and the second rear side outer edge 65 are formed in line symmetry (left-right symmetry) with respect to the virtual line.

As illustrated in FIG. 4, the second front side outer edge 64 and the second rear side outer edge 65 respectively include second base edge portions 64*a* and 65*a* disposed spaced apart from each other in the front-rear direction X, second lower side inclined edge portions 64*b* and 65*b* extending from lower ends of the second base edge portions 64*a* and 65*a* to a second lower end coupling portion 63*a* coupling lower ends of the second front side outer edge 64 and the second rear side outer edge 65 to each other, and second upper side inclined edge portions 64*c* and 65*c* extending from upper ends of the second base edge portions 64*a* and 65*a* to a second upper end coupling portion 63*b* coupling upper ends of the second front side outer edge 64 and the second rear side outer edge 65 to each other.

As illustrated in FIG. 4, the second base edge portions 64*a* and 65*a* are formed linearly extending in the up-down direction Y.

As illustrated in FIG. 4, the second lower side inclined edge portions 64*b* and 65*b* extend linearly so as to be inclined in the up-down direction Y inwardly in the front-rear direction X (at an inclination angle of 45° in the present embodiment) toward the lower side.

As illustrated in FIG. 4, the second upper side inclined edge portions 64*c* and 65*c* extend linearly so as to be inclined in the up-down direction Y inwardly in the front-rear direction X toward the upper side.

Figure 5:
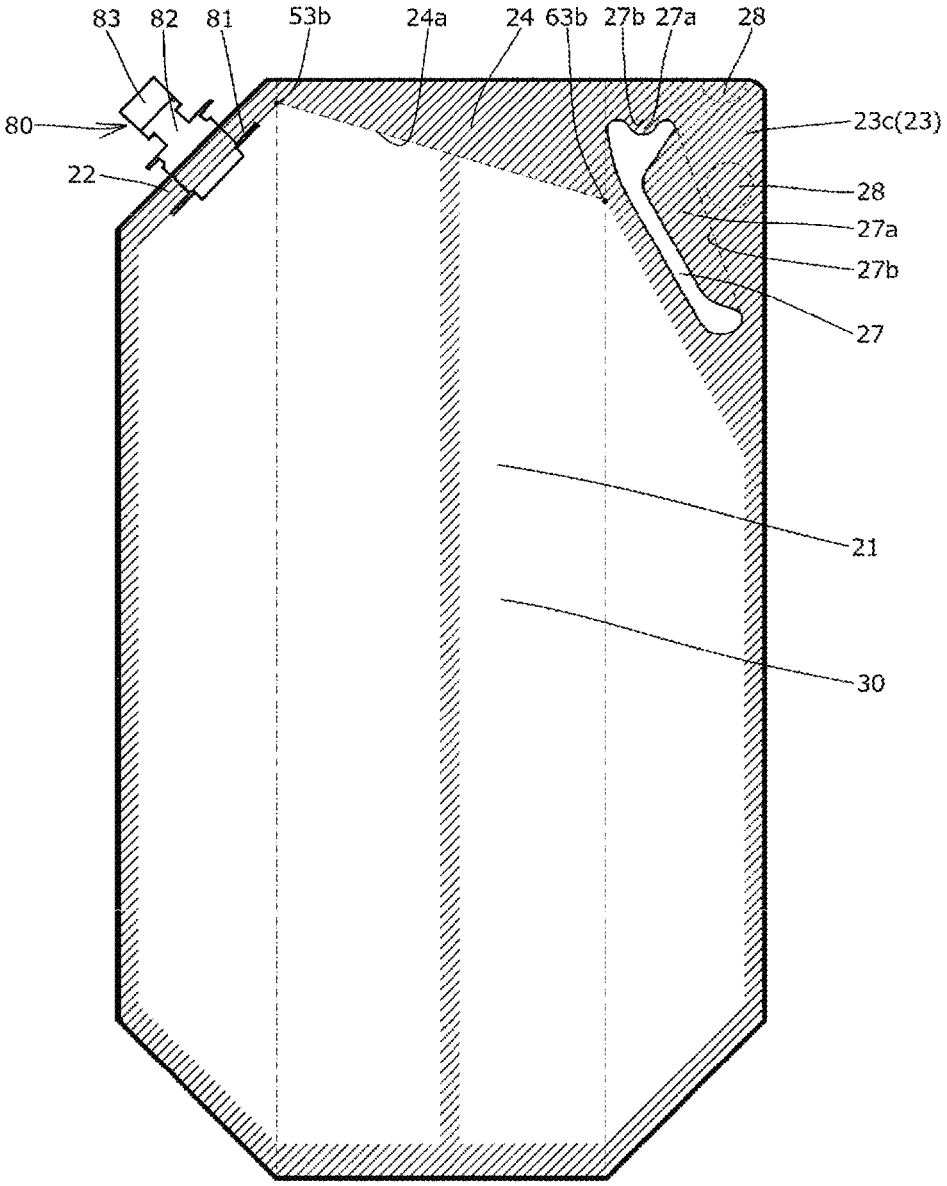
FIG. 5 is an explanatory view illustrating the spout pouch viewed from a front side film side.

Here, as illustrated in FIG. 5, the second upper end coupling portion 63*b* is formed at a position lower than that of the first upper end coupling portion 53*b* in the up-down direction Y.

Accordingly, as illustrated in FIG. 5, a top seal inner edge 24*a* of the top seal 24 facing the content liquid accommodating portion 21 side includes a portion downwardly inclined from the first upper end coupling portion 53*b* side toward the second upper end coupling portion 63*b* side (in the present embodiment, the top seal inner edge 24*a* is entirely inclined). The top seal inner edge 24*a* is formed to couple the first upper end coupling portion 53*b* and the second upper end coupling portion 63*b* to each other.

Figure 7:
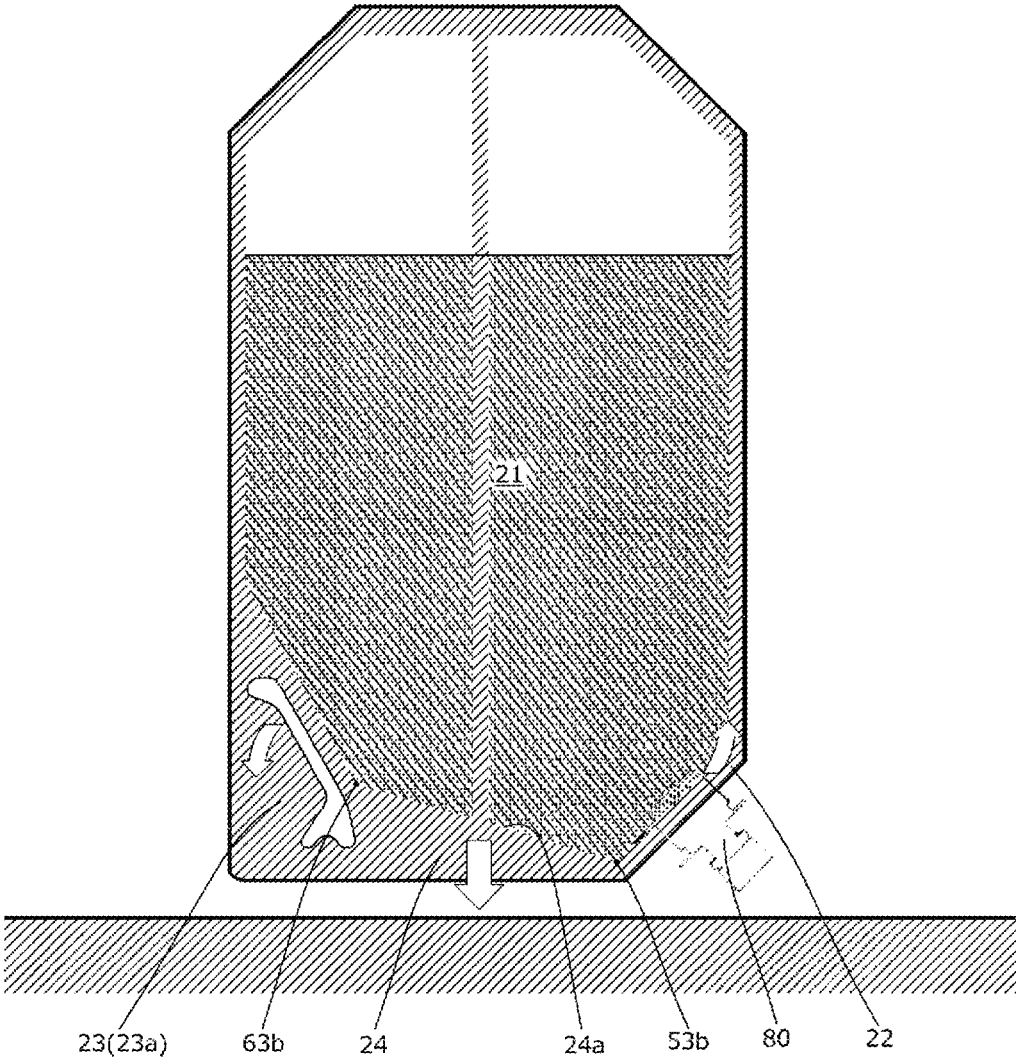
FIG. 7 is an explanatory view for describing a behavior when the spout pouch is dropped.

Thus, as illustrated in FIG. 7, when the spout pouch 10 is dropped with the top seal 24 side facing downward, and the top seal 24 (and the second side seal 23) is buckled due to the weight of the content liquid in the content liquid accommodating portion 21 at the time of collision with a floor surface or the like, a posture of the pouch main body 20 can be guided such that the first upper end coupling portion 53*b* (the first side seal 22 side, the right side in FIG. 7) attached with the spout 80 is positioned more upward than the second upper end coupling portion 63*b* (the second side seal 23 side, the left side in FIG. 7), resulting in suppressing collision of the spout 80 with the floor surface or the like and suppressing breakage of the spout 80 and leakage of the content liquid caused by the breakage.

Note that, in the present embodiment, as illustrated in FIG. 5, the top seal inner edge 24*a* is constituted by a linear portion downwardly inclined from the first upper end coupling portion 53*b* side toward the second upper end coupling portion 63*b* side.

Figure 6A:
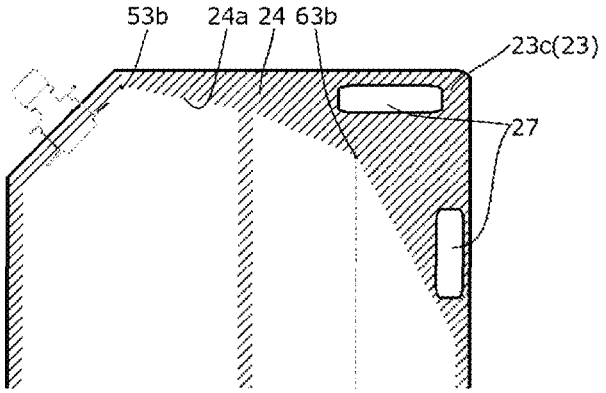
FIG. 6A is an explanatory view illustrating a modified example of a top seal inner edge and a grip-use film penetrating portion.
Figure 6B:
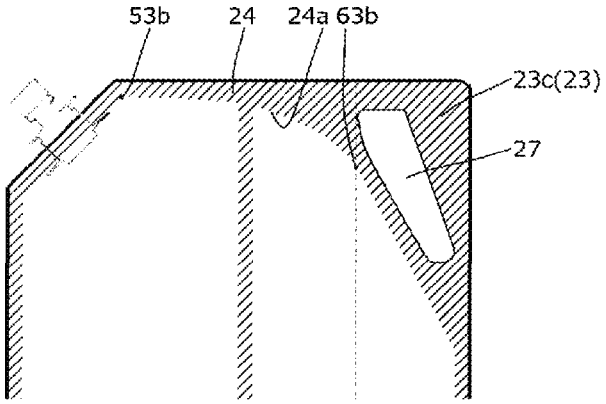
FIG. 6B is an explanatory view illustrating a modified example of the top seal inner edge and the grip-use film penetrating portion.

However, as long as in a specific aspect, the top seal inner edge 24*a* includes a portion downwardly inclined from the first upper end coupling portion 53*b* side to the second upper end coupling portion 63*b* side and couples the first upper end coupling portion 53*b* and the second upper end coupling portion 63*b*, the top seal inner edge 24*a* may be formed by combining two or more linear portions having different inclination angles as illustrated in FIG. 6A, may be constituted by one curved portion or two or more curved portions (portions extending in a curved line shape in a plan view in the front-back direction Z) as illustrated in FIG. 6B, or may be formed by combining one or more linear portions or one or more curved portions.

The spout 80 is formed of a synthetic resin or the like, is attached to the pouch main body 20 to function as a spouting outlet for the content liquid and, as illustrated in FIG. 1 and FIG. 5, and includes the flange 81 disposed facing the first gusset film 50, the spouting tubular portion 82 that extends perpendicularly to the flange 81 having a disk shape and that includes a spouting hole formed therein, and a cap 83 detachably attached to a tip end of the spouting tubular portion 82.

In the present embodiment, the flange 81 is formed as a portion having a disk shape (annular shape) with a through hole formed at a central portion thereof and an outer peripheral edge having a circular shape (flange outer peripheral edge), is disposed on an inner side of the pouch main body 20, and is at least partially fixed to an inner side surface of the first gusset film 50 by thermal sealing.

Note that FIG. 1 illustrates only the flange 81 of the spout 80 and, as illustrated in FIG. 5, most of the spout 80, such as the spouting tubular portion 82 and the cap 83, is disposed outside the pouch main body 20.

As illustrated in FIG. 3, at least a portion (all portion in the present embodiment) of the flange 81 (flange facing region 56) including a central portion of the flange 81 (flange facing region 56) is disposed facing a region between the first upper side inclined edge portion 54*c* of the first front side outer edge 54 and the first upper side inclined edge portion 55*c* of the first rear side outer edge 55.

Further, as illustrated in FIG. 3, the flange 81 (flange facing region 56) is disposed at a central portion of the first gusset film 50 in the front-rear direction X, and an interval between the first front side outer edge 54 and an outer edge of the flange 81 (flange facing region 56) and an interval between the first rear side outer edge 55 and the outer edge of the flange 81 (flange facing region 56) in the front-rear direction X are equal to each other.

As understood from FIG. 1, the region between the first upper side inclined edge portion 54*c* of the first front side outer edge 54 and the first upper side inclined edge portion 55*c* of the first rear side outer edge 55 to which the flange 81 is (at least partially) attached as described above is a portion inclined inwardly of the pouch main body 20 in the front-back direction Z toward the upper side in a view in the front-rear direction X in a state in which the spout pouch 10 is placed on a placement surface with the pouch bottom portion 20*a* facing downward. Therefore, in a state in which the spout pouch 10 is placed on the placement surface, as understood from FIG. 1 and FIG. 5, when viewed in the front-rear direction X, the spouting tubular portion 82 of the spout 80 attached to the region described above faces obliquely upward so as to extend obliquely with respect to the up-down direction Y (and the front-back direction Z), in other words, is inclined outwardly of the pouch main body 20 in the front-back direction Z toward the upper side.

The inner side film 70 is formed as a resin film having a rectangular shape (or substantially rectangular shape) and flexibility with a heat sealing layer provided on at least one side thereof and, as understood from FIG. 1 and FIG. 2, is disposed in the pouch main body 20 (content liquid accommodating portion 21) in a state of being folded in two, and a predetermined portion thereof is thermally sealed to the films 30 and 40.

As illustrated in FIG. 2, the inner side film 70 is formed with a plurality of film penetrating portions formed in hole shapes penetrating in the film thickness direction.

In addition, as illustrated in FIG. 1 and FIG. 5, the spout pouch 10 is provided with a grip-use film penetrating portion 27 through which a user passes his/her hand or finger to grip the pouch main body 20.

As illustrated in FIG. 1 and FIG. 2, the grip-use film penetrating portion 27 is formed so as to penetrate the films 30, 40, and 60 in the film thickness direction.

Note that FIG. 2 illustrates the grip-use film penetrating portion 27 being formed in a state in which the films 30, 40, and 60 are not thermally sealed to one another for convenience of technical understanding. However, in the present embodiment, the grip-use film penetrating portion 27 is formed by punching at a predetermined position after the films 30, 40, and 60 are thermally sealed to one another.

Here, as illustrated in FIG. 4, the second side seal 23 includes (two) second side sealing regions 23*a* at both sides in the front-rear direction positioned on sides of the second base edge portions 64*a* and 65*a* (on sides in the front-rear direction X), (two) second lower side sealing regions 23*b* at both sides in the front-rear direction positioned more downward than the second side sealing regions 23*a*, and (two) second upper side sealing regions 23*c* at both sides in the front-rear direction positioned more upward than the second side sealing regions 23*a* (in other words, a portion obtained by adding portions positioned on sides of the second upper side inclined edge portions 64*c* and 65*c* in the front-rear direction X and portions positioned more upward than the portions).

Then, as illustrated in FIG. 4 and FIG. 5, at least a part (in the present embodiment, the entirety) of the grip-use film penetrating portion 27 is formed in each of the second upper side sealing regions 23*c* at both sides in the front-rear direction.

Note that, of the (two) second upper side sealing regions 23*c* at both sides in the front-rear direction, one (the second upper side sealing region 23*c* illustrated on the left side in FIG. 4) is a region in which the films 30 and 60 are thermally sealed, and the other (the second upper side sealing region 23*c* illustrated on the right side in FIG. 4) is a region in which the films 40 and 60 are thermally sealed.

Here, as described above, by forming the grip-use film penetrating portion 27 in the second upper side sealing region 23*c*, as can be seen from FIG. 5, in a state where the spout pouch 10 is lifted up by utilizing the grip-use film penetrating portion 27, the spout pouch 10 can be guided to a posture in which the first side seal 22 side (left side in FIG. 5) attached with the spout 80 is lowered and the spouting tubular portion 82 of the spout 80 faces sideways. Accordingly, the content liquid from the spout 80 can be smoothly spouted.

As illustrated in FIG. 4 and FIG. 5, the pouch main body 20 includes (two in the present embodiment) grip-use piece portions 27*a* partitioned from a peripheral portion by the grip-use film penetrating portion 27. The grip-use piece portion 27*a* is provided to avoid a pain of a finger or the like of a user due to direct contact with the inner edge portion of the grip-use film penetrating portion 27 when the user passes his/her finger or hand through the hole formed by the grip-use film penetrating portion 27 to lift up the spout pouch 10, and a part of the outer edge thereof is coupled to the peripheral portion by a folding-use coupling portion 27*b*.

As illustrated in FIG. 4 and FIG. 5, the folding-use coupling portion 27*b* for the at least one (all in the present embodiment) grip-use piece portion 27*a* among the plurality of (two) grip-use piece portions 27*a* is formed in the second upper side sealing region 23*c*.

Further, the folding-use coupling portion 27*b* is formed in a portion, of the outer edge of the grip-use piece portion 27*a*, positioned outside the pouch. Thus, when the spout pouch 10 is lifted up by passing the user's finger or the like through the hole constituted by the grip-use film penetrating portion 27, the user's finger or the like comes into contact with the films 30, 40, and 60 that are folded in the vicinity of the folding-use coupling portion 27*b*, resulting in avoiding a pain of the user's finger or the like.

Additionally, as illustrated in FIG. 5, the inner side surfaces of the second upper side sealing regions 23*c* at both sides in the front-rear direction are fixed to each other at a fixing control portion 28 formed at a portion positioned on the outer side (outer edge side of the films 30, 40, and 60) of the pouch than the grip-use film penetrating portion 27, which prevents the second upper side sealing regions 23*c* at both sides in the front-rear direction from being separated from each other and allows the user's finger or the like to easily pass through the hole constituted by the grip-use film penetrating portion 27.

Here, as illustrated in FIG. 4, the two grip-use film penetrating portions 27 are formed in line symmetry (left-right symmetry) with respect to a virtual line extending along the up-down direction Y at the central portion of the second gusset film 60 in the front-rear direction X. Moreover, in a state where the second upper side sealing regions 23*c* at both sides in the front-rear direction are fixed at the fixing control portion 28, the positions and shapes of the grip-use film penetrating portions 27 at both sides in the front-rear direction overlap each other when viewed in the front-rear direction X as can be seen from FIG. 5. However, the two grip-use film penetrating portions 27 may be formed so as to have shapes and sizes different from each other without forming the two grip-use film penetrating portions 27 in left-right symmetry.

Figure 8:
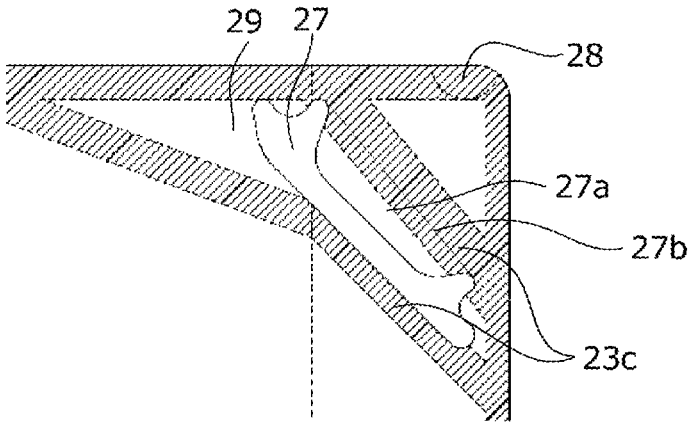
FIG. 8 is an explanatory view illustrating a grip-use film penetrating portion according to another embodiment.

Further, as illustrated in FIG. 8, a second outer side non-sealing region 29 surrounded by the second upper side sealing region 23*c* of the second gusset film 60 may be provided, and the grip-use film penetrating portion 27 through which a user passes his/her hand or finger to grip the pouch main body 20 may be provided in the second outer side non-sealing region 29.

In this embodiment, most part of the grip-use film penetrating portion 27 is provided in the second outer side non-sealing region 29, and a part thereof is formed in the second upper side sealing region 23*c*.

As illustrated in FIG. 8, the pouch main body 20 is provided with the grip-use piece portion 27*a* partitioned from the peripheral portion by the grip-use film penetrating portion 27.

The grip-use piece portion 27*a* is provided to avoid a pain of a finger or the like of a user due to direct contact with the inner edge portion of the grip-use film penetrating portion 27 when the user passes his/her finger or hand through the hole formed by the grip-use film penetrating portion 27 to lift up the spout pouch 10, and a part of the outer edge thereof is coupled to the peripheral portion by the folding-use coupling portion 27*b*.

As illustrated in FIG. 8, the folding-use coupling portion 27*b* of the compound grip-use piece portion 27*a* is formed in the second upper side sealing region 23*c*.

Further, the folding-use coupling portion 27*b* is formed in a portion, of the outer edge of the grip-use piece portion 27*a*, positioned outside the pouch. Thus, when the spout pouch 10 is lifted up by passing the user's finger or the like through the hole constituted by the grip-use film penetrating portion 27, the user's finger or the like comes into contact with the films 30, 40, and 60 that are folded in the vicinity of the folding-use coupling portion 27*b*, resulting in avoiding a pain of the user's finger or the like.

Figure 9A:
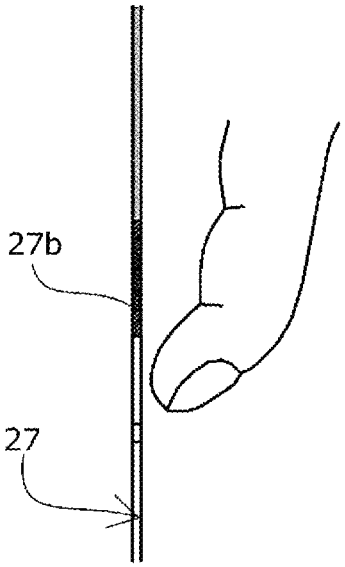
FIGS. 9A to 9C are explanatory views when the grip-use film penetrating portion of FIG. 8 is gripped.
Figure 9B:
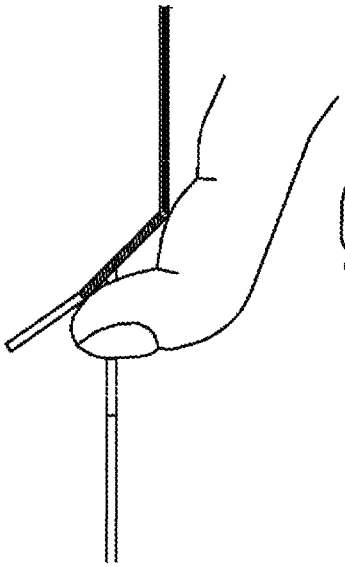
Figure 9C:
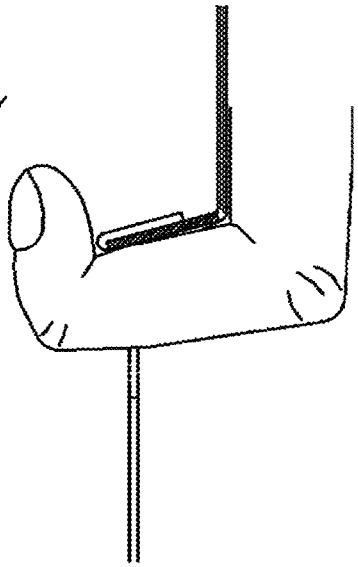

Further, in the present embodiment, since the folding-use coupling portion 27*b* side of the grip-use piece portion 27*a* is disposed in the second upper side sealing region 23*c* and the tip end side thereof is disposed in the second outer side non-sealing region 29, as illustrated in FIGS. 9A to 9C, the portion disposed in the second outer non-sealing region 29 is easily folded, which makes it possible to further avoid a pain of the user's finger or the like.

In addition, since a part of the grip-use film penetrating portion 27 is disposed in the second upper side sealing region 23*c*, when the grip-use film penetrating portion 27 is punched after sealing, the cut piece is discharged in a state in which the cut piece is partially connected, and thus processing of the cut piece is facilitated.

Additionally, as illustrated in FIG. 5, the inner side surfaces of the second upper side sealing regions 23*c* at both sides in the front-rear direction are fixed to each other at the fixing control portion 28 formed at a portion positioned on the outer side (outer edge side of the films 30, 40, and 60) of the pouch than the grip-use film penetrating portion 27, which prevents the second upper side sealing regions 23*c* at both sides in the front-rear direction from being separated from each other and allows the user's finger or the like to easily pass through the hole constituted by the grip-use film penetrating portion 27.

Further, in the present embodiment, here, as can be seen from FIG. 8, the positions and shapes of the two grip-use film penetrating portions 27 at both sides in the front-rear direction overlap each other when viewed in the front-rear direction. However, the two grip-use film penetrating portions 27 may be formed so as to have shapes and sizes different from each other without forming the two grip-use film penetrating portions 27 in left-right symmetry.

Note that in the above-described embodiment, the second gusset film 60 is partially removed and the films 30 and 40 are thermally sealed to each other at the fixing control portion 28 so that the second upper side sealing regions 23*c* at both sides in the front-rear direction are fixed to each other at the fixing control portion 28. However, the second upper side sealing regions 23*c* may be fixed to each other at the fixing control portion 28 by any method such as a method using an adhesive or a molten resin.

The embodiments of the disclosure have been described in detail above, but the disclosure is not limited to the embodiments described above, and various design modifications can be made insofar as they do not depart from the scope of the claims of the disclosure. Further, the spout pouch 10 may be configured by any combination of configurations of the embodiments described above and modified examples, which will be described below.

For example, the spout pouch 10 may be accommodated and utilized in the outer case (not illustrated) during usage, during display, or during transport thereof, and the spout pouch 10 itself may be used, displayed, or transported, without being accommodated in the outer case (not illustrated).

Further, with respect to specific aspects of the respective films 30, 40, 50, 60, and 70, as long as each film includes a layer having a thermal sealing property, such as an olefin-based layer made of low density polyethylene or polypropylene or a polyester-based layer made of polyethylene terephthalate (PET), or the like on at least one of the surfaces thereof, a single film of the heat sealing layer may be used, or any desired layer may be layered to the heat sealing layer. Any material may be used as a material constituting the multilayer, and the multilayer may be formed as desired by layering a known polyester such as PET or polybutylene terephthalate (PBT), polyamide such as nylon, polyolefin such as polypropylene, or polyethylene, aluminum foil, or the like.

Further, in the embodiment described above, the pouch main body 20 has been described as being formed of four films, namely the films 30, 40, 50, and 60. However, a specific aspect of the pouch main body 20, such as the number of films constituting the pouch main body 20, is not limited to the above and, for example, a gusset film for the bottom portion may be separately provided at a position corresponding to the pouch bottom portion 20*a*.

Further, the inner side film 70 need not be provided.

Further, in the embodiment described above, the spout pouch 10 is configured as a large-capacity pouch having a volume of 2 to 5 L, and the spout 80 is configured as a large spout with an outer diameter of the flange 81 being 50 to 70 mm. However, the sizes of the spout pouch 10 and the spout 80 are not limited thereto and may be set as desired in accordance with the embodiment.

Further, in the embodiment described above, the first front side outer edge 54 and the first rear side outer edge 55 have been described as being formed in line symmetry (left-right symmetry) with respect to the virtual line extending in the up-down direction Y at the central portion of the first gusset film 50 in the front-rear direction X. However, the first front side outer edge 54 and the first rear side outer edge 55 may be formed not in left-right symmetry.

Further, similarly, in the embodiment described above, the second front side outer edge 64 and the second rear side outer edge 65 have been described as being formed in line symmetry (left-right symmetry) with respect to the virtual line extending in the up-down direction Y at the central portion of the second gusset film 60 in the front-rear direction X. However, the second front side outer edge 64 and the second rear side outer edge 65 may be formed not in left-right symmetry.

Further, in the embodiment described above, the flange 81 has been described as being formed in a disk shape with an outer peripheral edge having a circular shape. However, the specific shape of the flange 81 may be any shape such as a shape having an outer peripheral edge (flange outer peripheral edge) of a shape other than a circular shape, such as a rectangular shape or a polygonal shape.

Further, in the embodiment described above, the flange 81 has been described as being fixed to the inner side surface of the first gusset film 50. However, the flange 81 may be fixed to an outer side surface of the first gusset film 50.

Further, the flange 81 may be fixed to the first gusset film 50 by any method other than thermal sealing, such as adhesion.

Note that the terms "top portion," "bottom portion," "side portion," and the like indicating up and down directions are used herein, but these terms do not limit the orientation of the placement of the spout pouch 10 during display, during transport, and the like. For example, the spout pouch 10 may be placed on the placement surface with the side portion or the top portion of the spout pouch 10 facing downward during display, during transport, and the like.

First, in the embodiment described above, the inclined edge portions 54*b*, 54*c*, 55*c*, 55*b*, 64*b*, 64*c*, 65*c*, and 65*b* have been described as being constituted by one linear portion extending in an inclined manner in the up-down direction Y, but the specific aspect of the inclined portions 54*b*, 54*c*, 55*c*, 55*b*, 64*b*, 64*c*, 65*c*, and 65*b* is not limited thereto, and each of the inclined portions 54*b*, 54*c*, 55*c*, 55*b*, 64*b*, 64*c*, 65*c*, and 65*b* may be constituted by at least one linear portion, at least one curved portion, or a combination thereof.

In addition, in the above-described embodiment, as illustrated in FIG. 2 and the like, the grip-use film penetrating portion 27 has been described as being formed in a hole shape (or a slit shape with a width) penetrating the films 30, 40, and 60 in the film thickness direction. However, the specific aspect of the grip-use film penetrating portion 27 is not limited thereto, and the grip-use film penetrating portion 27 may be formed as a slit having a cutout shape penetrating the films 30, 40, and 60 in the film thickness direction (the slit whose material is not removed and that does not have a width in a direction orthogonal to an extending direction thereof). Note that when the grip-use film penetrating portion 27 is formed in a hole shape (or a slit shape having a width), the visibility of the grip-use film penetrating portion 27 can be improved, and the position and the presence of the grip-use film penetrating portion 27 can be easily noticed.

In addition, in the above-described embodiment, as illustrated in FIG. 4 and FIG. 5, the entirety of the grip-use film penetrating portion 27 has been described as being formed in the second upper side sealing region 23*c*, and as illustrated in FIG. 8, the grip-use film penetrating portion 27 has been described as being formed in the second outer side non-sealing region 29. However, as illustrated in FIG. 6A, a part of the grip-use film penetrating portion 27 may be formed in a portion other than the second upper side sealing region 23*c* (that is, in the top seal 24 or the second side sealing region 23*a*).

Further, in the above-described embodiment, the grip-use film penetrating portion 27 has been described as being formed such that the grip-use piece portion 27*a* is formed in the pouch main body 20. However, a specific aspect of the grip-use film penetrating portion 27 is not limited to the above-described form, and the grip-use film penetrating portion 27 may be formed such that the grip-use piece portion 27*a* is not formed as illustrated in FIG. 6B.

Furthermore, in the above-described embodiment, as illustrated in FIG. 4, two grip-use piece portions 27*a* have been described as being formed for each grip-use film penetrating portion 27, but the number of grip-use piece portions 27*a* may be one or three or more for each grip-use film penetrating portion 27.

(Supplementary Note 1)

A spout pouch including a front side film, a rear side film, a first gusset film thermally sealed to the front side film and the rear side film by using a first side seal, a second gusset film disposed facing the first gusset film in a front-back direction with a content liquid accommodating portion interposed between the first gusset portion and the second gusset portion, the second gusset film being thermally sealed to the front side film and the rear side film by using a second side seal, a spout attached to the first gusset film, and a grip-use film penetrating portion configured to be gripped by a user, wherein the first gusset film includes a first front side sealing region thermally sealed to the front side film at the first side seal, a first rear side sealing region thermally sealed to the rear side film at the first side seal, and a first non-sealing region serving as a region inside the first front side sealing region and the first rear side sealing region, the first non-sealing region includes a first front side outer edge serving as a boundary with the first front side sealing region, and a first rear side outer edge serving as a boundary with the first rear side sealing region, each of the first front side outer edge and the first rear side outer edge includes a first base edge portion, the first base edge portion of the first front side outer edge and the first base edge portion of the first rear side outer edge being disposed spaced apart from each other in a front-rear direction, and a first upper side inclined edge portion extending from an upper end of the first base edge portion to a first upper end coupling portion coupling an upper end of the first front side outer edge and an upper end of the first rear side outer edge, the second gusset film includes a second front side sealing region thermally sealed to the front side film at the second side seal, a second rear side sealing region thermally sealed to the rear side film at the second side seal, and a second non-sealing region serving as a region inside the second front side sealing region and the second rear side sealing region, the second non-sealing region includes a second front side outer edge serving as a boundary with the second front side sealing region, and a second rear side outer edge serving as a boundary with the second rear side sealing region, each of the second front side outer edge and the second rear side outer edge includes a second base edge portion, the second base edge portion of the second front side outer edge and the second base edge portion of the second rear side outer edge being disposed spaced apart from each other in the front-rear direction, and a second upper side inclined edge portion extending from an upper end of the second base edge portion to a second upper end coupling portion coupling an upper end of the second front side outer edge and an upper end of the second rear side outer edge, at least a portion of a flange of the spout is disposed facing a region between the first upper side inclined edge portion of the first front side outer edge and the first upper side inclined edge portion of the first rear side outer edge, and the second side seal includes a second side sealing region positioned on a side of the second base edge portion and a second upper side sealing region positioned more upward than the second side sealing region.

(Supplementary Note 2)

The spout pouch according to supplementary note 1, wherein at least a part of the grip-use film penetrating portion is formed in the second upper side sealing region.

(Supplementary Note 3)

The spout pouch according to supplementary note 1, wherein the second gusset film includes a second outer side non-sealing region that is outside the second upper side sealing region or that is surrounded by the second upper side sealing region, and at least a part of the grip-use film penetrating portion is formed in the second outer side non-sealing region.

(Supplementary Note 4)

The spout pouch according to any one of supplementary notes 1 to 3, wherein the second upper end coupling portion is formed at a position lower than the first upper end coupling portion in an up-down direction.

(Supplementary Note 5)

The spout pouch according to supplementary note 4, further including a top seal fixing the front side film and the rear side film between the first side seal and the second side seal in the front-back direction, wherein the top seal includes a top seal inner edge facing a side at which the content liquid accommodating portion is provided, and the top seal inner edge includes a portion downwardly inclined from a side at which the first upper end coupling portion is provided toward a side at which the second upper end coupling portion is provided, and is formed to couple the first upper end coupling portion and the second upper end coupling portion.

(Supplementary Note 6)

The spout pouch according to any one of supplementary notes 1 to 5, further including a grip-use piece portion partitioned from a peripheral portion by the grip-use film penetrating portion, wherein a part of an outer edge of the grip-use piece portion is coupled to the peripheral portion by a folding-use coupling portion, and the folding-use coupling portion is formed in the second upper side sealing region.

(Supplementary Note 7)

The spout pouch according to any one of supplementary notes 1 to 6, wherein at least a part of the grip-use film penetrating portion is formed in each of the second upper side sealing regions at both sides in the front-rear direction, and a fixing control portion fixing the second upper side sealing regions at the both sides in the front-rear direction to each other is provided.

(Supplementary Note 8)

The spout pouch according to any one of supplementary notes 1 to 7, wherein the second gusset film includes a second outer side non-sealing region that is outside the second upper side sealing region or that is surrounded by the second upper side sealing region, and at least a part of the grip-use film penetrating portion is formed in each of the second outer side non-sealing regions at both sides in the front-rear direction, and a fixing control portion fixing the second upper side sealing regions at the both sides in the front-rear direction to each other is provided.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

The invention claimed is:

1. A spout pouch comprising:

a front side film;

a rear side film;

a first gusset film thermally sealed to the front side film and the rear side film by using a first side seal;

a second gusset film disposed facing the first gusset film in a front-back direction with a content liquid accommodating portion interposed between the first gusset film and the second gusset film, the second gusset film being thermally sealed to the front side film and the rear side film by using a second side seal;

a spout attached to the first gusset film; and a grip-use film penetrating portion configured to be gripped by a user, wherein the first gusset film includes a first front side sealing region thermally sealed to the front side film at the first side seal, a first rear side sealing region thermally sealed to the rear side film at the first side seal, and a first non-sealing region serving as a region inside the first front side sealing region and the first rear side sealing region, the first non-sealing region includes a first front side outer edge serving as a boundary with the first front side sealing region, and a first rear side outer edge serving as a boundary with the first rear side sealing region, each of the first front side outer edge and the first rear side outer edge includes a first base edge portion, the first base edge portion of the first front side outer edge and the first base edge portion of the first rear side outer edge being disposed spaced apart from each other in a front-rear direction, and a first upper side inclined edge portion extending from an upper end of the first base edge portion to a first upper end coupling portion coupling an upper end of the first front side outer edge and an upper end of the first rear side outer edge, the second gusset film includes a second front side sealing region thermally sealed to the front side film at the second side seal, a second rear side sealing region thermally sealed to the rear side film at the second side seal, and a second non-sealing region serving as a region inside the second front side sealing region and the second rear side sealing region, the second non-sealing region includes a second front side outer edge serving as a boundary with the second front side sealing region, and a second rear side outer edge serving as a boundary with the second rear side sealing region, each of the second front side outer edge and the second rear side outer edge includes a second base edge portion, the second base edge portion of the second front side outer edge and the second base edge portion of the second rear side outer edge being disposed spaced apart from each other in the front-rear direction, and a second upper side inclined edge portion extending from an upper end of the second base edge portion to a second upper end coupling portion coupling an upper end of the second front side outer edge and an upper end of the second rear side outer edge, at least a portion of a flange of the spout is disposed facing a region between the first upper side inclined edge portion of the first front side outer edge and the first upper side inclined edge portion of the first rear side outer edge, the second side seal includes a second side sealing region positioned on a side of the second base edge portion and a second upper side sealing region positioned more upward than the second side sealing region, the second gusset film includes a second outer side non-sealing region that is outside the second upper side sealing region or that is surrounded by the second upper side sealing region, and at least a part of the grip-use film penetrating portion is formed in the second outer side non-sealing region.

2. The spout pouch according to claim 1, wherein at least a part of the grip-use film penetrating portion is formed in the second upper side sealing region.

3. The spout pouch according to claim 1, wherein at least a part of the grip-use film penetrating portion is formed in each of the second upper side sealing regions at both sides in the front-rear direction, and a fixing control portion fixing the second upper side sealing regions at the both sides in the front-rear direction to each other is provided.

4. The spout pouch according to claim 1, wherein at least a part of the grip-use film penetrating portion is formed in each of the second outer side non-sealing regions at both sides in the front-rear direction, and a fixing control portion fixing the second upper side sealing regions at the both sides in the front-rear direction to each other is provided.

5. The spout pouch according to claim 1, wherein the second upper end coupling portion is formed at a position lower than the first upper end coupling portion in an up-down direction.

6. The spout pouch according to claim 5, further comprising a top seal fixing the front side film and the rear side film between the first side seal and the second side seal in the front-back direction, wherein the top seal includes a top seal inner edge facing a side at which the content liquid accommodating portion is provided, and the top seal inner edge includes a portion downwardly inclined from a side at which the first upper end coupling portion is provided toward a side at which the second upper end coupling portion is provided, and is formed to couple the first upper end coupling portion and the second upper end coupling portion.

7. The spout pouch according to claim 1, further comprising a grip-use piece portion partitioned from a peripheral portion by the grip-use film penetrating portion, wherein a part of an outer edge of the grip-use piece portion is coupled to the peripheral portion by a folding-use coupling portion, and the folding-use coupling portion is formed in the second upper side sealing region.

8. The spout pouch according to claim 1, wherein at least a part of the grip-use film penetrating portion is formed in each of the second upper side sealing regions at both sides in the front-rear direction, and a fixing control portion fixing the second upper side sealing regions at the both sides in the front-rear direction to each other is provided.

9. A spout pouch comprising:

a front side film;

a rear side film;

a first gusset film thermally sealed to the front side film and the rear side film by using a first side seal;

a second gusset film disposed facing the first gusset film in a front-back direction with a content liquid accommodating portion interposed between the first gusset film and the second gusset film, the second gusset film being thermally sealed to the front side film and the rear side film by using a second side seal;

a spout attached to the first gusset film; and a grip-use film penetrating portion configured to be gripped by a user, wherein the first gusset film includes a first front side sealing region thermally sealed to the front side film at the first side seal, a first rear side sealing region thermally sealed to the rear side film at the first side seal, and a first non-sealing region serving as a region inside the first front side sealing region and the first rear side sealing region, the first non-sealing region includes a first front side outer edge serving as a boundary with the first front side sealing region, and a first rear side outer edge serving as a boundary with the first rear side sealing region, each of the first front side outer edge and the first rear side outer edge includes a first base edge portion, the first base edge portion of the first front side outer edge and the first base edge portion of the first rear side outer edge being disposed spaced apart from each other in a front-rear direction, and a first upper side inclined edge portion extending from an upper end of the first base edge portion to a first upper end coupling portion coupling an upper end of the first front side outer edge and an upper end of the first rear side outer edge, the second gusset film includes a second front side sealing region thermally sealed to the front side film at the second side seal, a second rear side sealing region thermally sealed to the rear side film at the second side seal, and a second non-sealing region serving as a region inside the second front side sealing region and the second rear side sealing region, the second non-sealing region includes a second front side outer edge serving as a boundary with the second front side sealing region, and a second rear side outer edge serving as a boundary with the second rear side sealing region, each of the second front side outer edge and the second rear side outer edge includes a second base edge portion, the second base edge portion of the second front side outer edge and the second base edge portion of the second rear side outer edge being disposed spaced apart from each other in the front-rear direction, and a second upper side inclined edge portion extending from an upper end of the second base edge portion to a second upper end coupling portion coupling an upper end of the second front side outer edge and an upper end of the second rear side outer edge, at least a portion of a flange of the spout is disposed facing a region between the first upper side inclined edge portion of the first front side outer edge and the first upper side inclined edge portion of the first rear side outer edge, and the second side seal includes a second side sealing region positioned on a side of the second base edge portion and a second upper side sealing region positioned more upward than the second side sealing region, wherein the second upper end coupling portion is formed at a position lower than the first upper end coupling portion in an up-down direction.

10. The spout pouch according to claim 9, further comprising:

a top seal fixing the front side film and the rear side film between the first side seal and the second side seal in the front-back direction, wherein the top seal includes a top seal inner edge facing a side at which the content liquid accommodating portion is provided, and the top seal inner edge includes a portion downwardly inclined from a side at which the first upper end coupling portion is provided toward a side at which the second upper end coupling portion is provided, and is formed to couple the first upper end coupling portion and the second upper end coupling portion.

11. The spout pouch according to claim 9, wherein the second gusset film includes a second outer side non-sealing region that is outside the second upper side sealing region or that is surrounded by the second upper side sealing region, and at least a part of the grip-use film penetrating portion is formed in the second outer side non-sealing region.

12. A spout pouch comprising:

a front side film;

a rear side film;

a first gusset film thermally sealed to the front side film and the rear side film by using a first side seal;

a second gusset film disposed facing the first gusset film in a front-back direction with a content liquid accommodating portion interposed between the first gusset film and the second gusset film, the second gusset film being thermally sealed to the front side film and the rear side film by using a second side seal;

a spout attached to the first gusset film;

a grip-use film penetrating portion configured to be gripped by a user; and a grip-use piece portion partitioned from a peripheral portion by the grip-use film penetrating portion, wherein the first gusset film includes a first front side sealing region thermally sealed to the front side film at the first side seal, a first rear side sealing region thermally sealed to the rear side film at the first side seal, and a first non-sealing region serving as a region inside the first front side sealing region and the first rear side sealing region, the first non-sealing region includes a first front side outer edge serving as a boundary with the first front side sealing region, and a first rear side outer edge serving as a boundary with the first rear side sealing region, each of the first front side outer edge and the first rear side outer edge includes a first base edge portion, the first base edge portion of the first front side outer edge and the first base edge portion of the first rear side outer edge being disposed spaced apart from each other in a front-rear direction, and a first upper side inclined edge portion extending from an upper end of the first base edge portion to a first upper end coupling portion coupling an upper end of the first front side outer edge and an upper end of the first rear side outer edge, the second gusset film includes a second front side sealing region thermally sealed to the front side film at the second side seal, a second rear side sealing region thermally sealed to the rear side film at the second side seal, and a second non-sealing region serving as a region inside the second front side sealing region and the second rear side sealing region, the second non-sealing region includes a second front side outer edge serving as a boundary with the second front side sealing region, and a second rear side outer edge serving as a boundary with the second rear side sealing region, each of the second front side outer edge and the second rear side outer edge includes a second base edge portion, the second base edge portion of the second front side outer edge and the second base edge portion of the second rear side outer edge being disposed spaced apart from each other in the front-rear direction, and a second upper side inclined edge portion extending from an upper end of the second base edge portion to a second upper end coupling portion coupling an upper end of the second front side outer edge and an upper end of the second rear side outer edge, at least a portion of a flange of the spout is disposed facing a region between the first upper side inclined edge portion of the first front side outer edge and the first upper side inclined edge portion of the first rear side outer edge, and the second side seal includes a second side sealing region positioned on a side of the second base edge portion and a second upper side sealing region positioned more upward than the second side sealing region, a part of an outer edge of the grip-use piece portion is coupled to the peripheral portion by a folding-use coupling portion, and the folding-use coupling portion is formed in the second upper side sealing region.

13. The spout pouch according to claim 6, wherein the second upper end coupling portion is formed at a position lower than the first upper end coupling portion in an up-down direction.

14. The spout pouch according to claim 12, wherein the second gusset film includes a second outer side non-sealing region that is outside the second upper side sealing region or that is surrounded by the second upper side sealing region, and at least a part of the grip-use film penetrating portion is formed in the second outer side non-sealing region.

15. A spout pouch comprising:

a front side film;

a rear side film;

a first gusset film thermally sealed to the front side film and the rear side film by using a first side seal;

a second gusset film disposed facing the first gusset film in a front-back direction with a content liquid accommodating portion interposed between the first gusset film and the second gusset film, the second gusset film being thermally sealed to the front side film and the rear side film by using a second side seal, a grip-use film penetrating portion configured to be gripped by a user, and a spout attached to the first gusset film, wherein the first gusset film includes a first front side sealing region thermally sealed to the front side film at the first side seal, a first rear side sealing region thermally sealed to the rear side film at the first side seal, and a first non-sealing region serving as a region inside the first front side sealing region and the first rear side sealing region, the first non-sealing region includes a first front side outer edge serving as a boundary with the first front side sealing region, and a first rear side outer edge serving as a boundary with the first rear side sealing region, each of the first front side outer edge and the first rear side outer edge includes a first base edge portion, the first base edge portion of the first front side outer edge and the first base edge portion of the first rear side outer edge being disposed spaced apart from each other in a front-rear direction, and a first upper side inclined edge portion extending from an upper end of the first base edge portion to a first upper end coupling portion coupling an upper end of the first front side outer edge and an upper end of the first rear side outer edge, the second gusset film includes a second front side sealing region thermally sealed to the front side film at the second side seal, a second rear side sealing region thermally sealed to the rear side film at the second side seal, and a second non-sealing region serving as a region inside the second front side sealing region and the second rear side sealing region, the second non-sealing region includes a second front side outer edge serving as a boundary with the second front side sealing region, and a second rear side outer edge serving as a boundary with the second rear side sealing region, each of the second front side outer edge and the second rear side outer edge includes a second base edge portion, the second base edge portion of the second front side outer edge and the second base edge portion of the second rear side outer edge being disposed spaced apart from each other in the front-rear direction, and a second upper side inclined edge portion extending from an upper end of the second base edge portion to a second upper end coupling portion coupling an upper end of the second front side outer edge and an upper end of the second rear side outer edge, at least a portion of a flange of the spout is disposed facing a region between the first upper side inclined edge portion of the first front side outer edge and the first upper side inclined edge portion of the first rear side outer edge, a top seal fixing the front side film and the rear side film between the first side seal and the second side seal in the front-back direction is provided, the top seal includes a top seal inner edge facing a side at which the content liquid accommodating portion is provided, the top seal inner edge includes a portion downwardly inclined from a side at which the first upper end coupling portion is provided toward a side at which the second upper end coupling portion is provided, and is formed to couple the first upper end coupling portion and the second upper end coupling portion, and the second side seal includes a second side sealing region positioned on a side of the second base edge portion and a second upper side sealing region positioned more upward than the second side sealing region, and the second gusset film includes a second outer side non-sealing region that is outside the second upper side sealing region or that is surrounded by the second upper side sealing region, and at least a part of the grip-use film penetrating portion is formed in the second outer side non-sealing region.

16. The spout pouch according to claim 15, wherein at least a part of the grip-use film penetrating portion is formed in the second upper side sealing region.

* * * * *